US005970549A

United States Patent [19]

Rudden

[11] Patent Number: 5,970,549

[45] Date of Patent: Oct. 26, 1999

[54] INFLATABLE SUPPORT SYSTEM

[76] Inventor: Edward P. Rudden, 13129 Isle of Mann, Highland, Md. 20777

[21] Appl. No.: 09/065,555

[22] Filed: Apr. 24, 1998

Related U.S. Application Data

[63] Continuation-in-part of application No. 08/806,720, Feb. 27, 1997.

[51] Int. Cl.[6] ..... A47C 27/08

[52] U.S. Cl. ..... 5/713; 5/655.3; 5/710; 5/659

[58] Field of Search ..... 5/644, 413 AM, 5/713, 728, 654, 655.3, 681, 632, 636, 727, 729, 659, 701, 694, 706, 710

[56] References Cited

U.S. PATENT DOCUMENTS

| | | | |
|---|---|---|---|
| 36,618 | 10/1862 | Linden | 5/655.3 X |
| 587,224 | 7/1897 | McKelvey . | |
| 795,108 | 7/1905 | Doellinger . | |
| 1,382,531 | 6/1921 | Newborn . | |
| 2,576,455 | 11/1951 | Gratt . | |
| 2,822,554 | 2/1958 | Wenzelberger | 5/655.3 |
| 3,140,897 | 7/1964 | Dougherty | 5/659 |
| 3,280,515 | 10/1966 | Eriksson | 5/659 |
| 3,644,949 | 2/1972 | Diamond . | |
| 3,722,012 | 3/1973 | Tobinick et al. . | |
| 3,883,906 | 5/1975 | Sumpter . | |
| 4,024,861 | 5/1977 | Vincent . | |
| 4,277,859 | 7/1981 | Seaman . | |
| 4,424,600 | 1/1984 | Callaway . | |
| 4,484,781 | 11/1984 | Phelps . | |
| 4,708,393 | 11/1987 | Fallis et al. . | |
| 4,745,645 | 5/1988 | McWilliams . | |
| 4,768,247 | 9/1988 | Beier . | |
| 4,815,155 | 3/1989 | Sommers | 5/659 |
| 4,876,756 | 10/1989 | Vaccaro . | |
| 4,908,895 | 3/1990 | Walker . | |
| 4,965,901 | 10/1990 | Normand | 5/710 |
| 5,168,590 | 12/1992 | O'Sullivan . | |
| 5,267,363 | 12/1993 | Chaffee . | |
| 5,363,523 | 11/1994 | Blackburn . | |
| 5,412,822 | 5/1995 | Kelly . | |
| 5,474,362 | 12/1995 | Albecker, III . | |
| 5,533,218 | 7/1996 | Fahy . | |

*Primary Examiner*—Michael F. Trettel
*Assistant Examiner*—Fredrick Conley
*Attorney, Agent, or Firm*—Nixon & Vanderhye P.C.

[57] ABSTRACT

An inflatable support assembly ensures adequate support and comfort for a traveler. The assembly includes an inflatable mattress, a cover shaped to encase the mattress, and at least one support member formed of a rigid material that is secured in a pocket or support member receptacle formed in the cover. In preferred forms, the support member is configured to resist bending in a first direction while permitting bending in a second direction, and the assembly includes two support members secured in two corresponding pockets in the cover and positioned adjacent a head/neck and back area relative to the mattress to maximize support and comfort. The assembly is also provided with a carrying case and a portable air pump.

24 Claims, 5 Drawing Sheets

10
12
14
16
18
20
22
24
26
M

INFLATABLE SUPPORT SYSTEM

This application is a Continuation-in-part of U.S. patent application Ser. No. 08/806,720, filed Feb. 27, 1997.

BACKGROUND OF THE INVENTION

The present invention relates to an inflatable traveling support bed and, in particular, to an inflatable support assembly and kit that includes rigid support members and can be portably contained in a carrying case.

Frequent travellers are often subjected to worn and sagging beds, resulting in discomfort, loss of sleep, aching backs, and the like. There have previously been known auxiliary devices for improving worn and sagging mattresses; however, these devices typically do not provide sufficient support or comfort and are not easily portable.

SUMMARY OF THE INVENTION

It is therefore an object of the invention to provide a portable support assembly that overcomes the drawbacks of previous assemblies. In particular, it is an object of the invention to provide an inflatable support assembly that is portable, self contained, and provides adequate support in order to maximize comfort and prevent backaches.

These and other objects are achieved by the inflatable support assembly according to the present invention. The assembly includes an inflatable mattress having a plurality of chambers, which are preferably individually inflatable to allow for different comfort settings. A cover is shaped to encase the mattress and includes one or more support member receptacles. The receptacles receive a corresponding number of rigid support members, which are preferably disposed adjacent a head/neck and back area relative to the mattress. The support members are configured to resist bending in a first direction while permitting bending in a second direction. The assembly also preferably includes a portable air pump that is operatively engageable with the chambers. Finally, the assembly includes a carrying case that is sized to receive the assembly to facilitate travel.

BRIEF DESCRIPTION OF THE DRAWINGS

These and other objects and advantages of the present invention will be described in detail with reference to the accompanying drawings, in which.

DETAILED DESCRIPTION OF PREFERRED EMBODIMENTS

Figure 1:
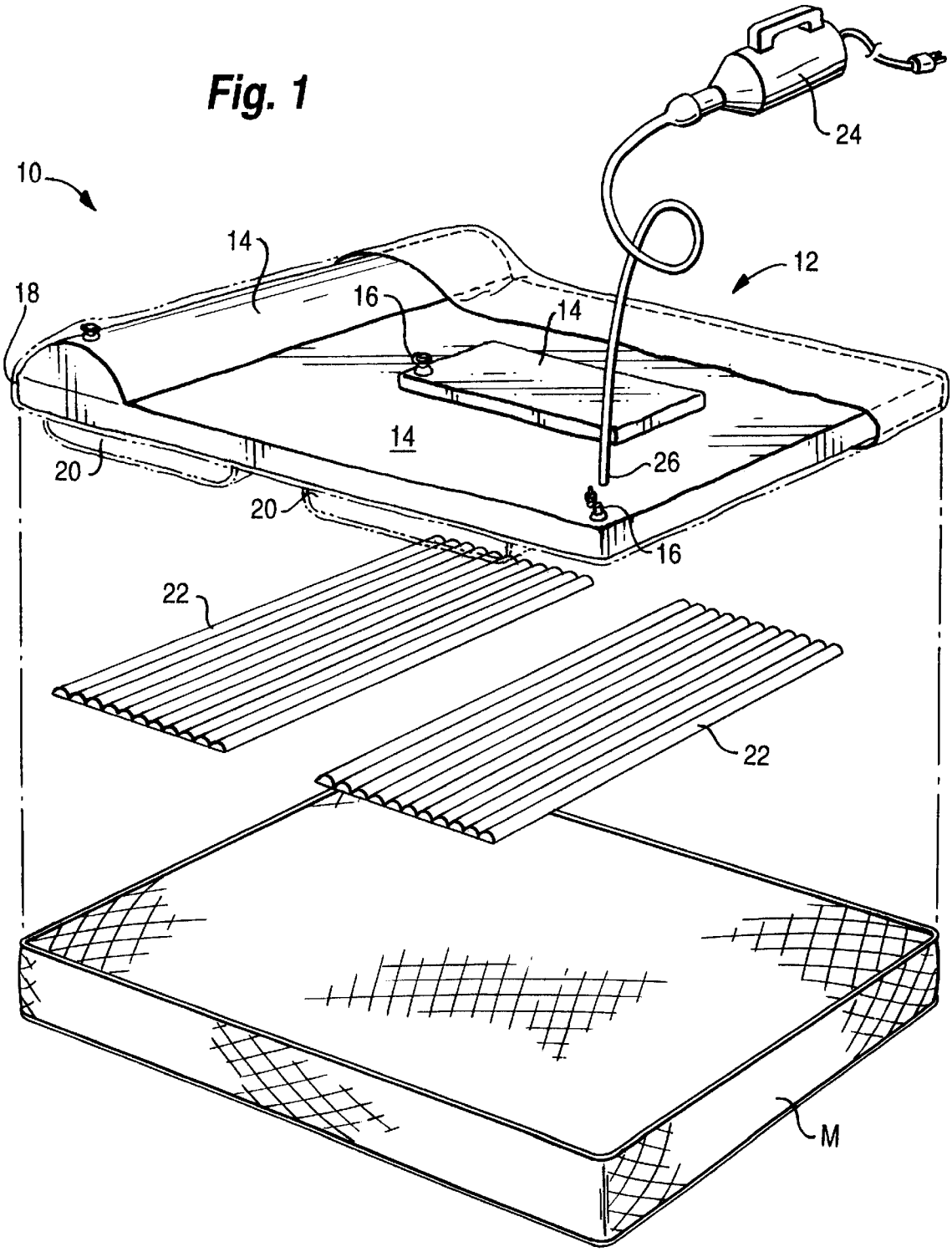
FIG. 1 is a perspective view of the inflatable support assembly according to the present invention.

FIG. 1 is a perspective view of the inflatable support assembly according to the present invention. As shown in FIG. 1, the assembly 10 is particularly suited for use on top of a mattress M; however, the assembly is also suitable for use on a floor, ground or other surface, and the invention is not meant to be limited to the illustrated application.

Figure 2:
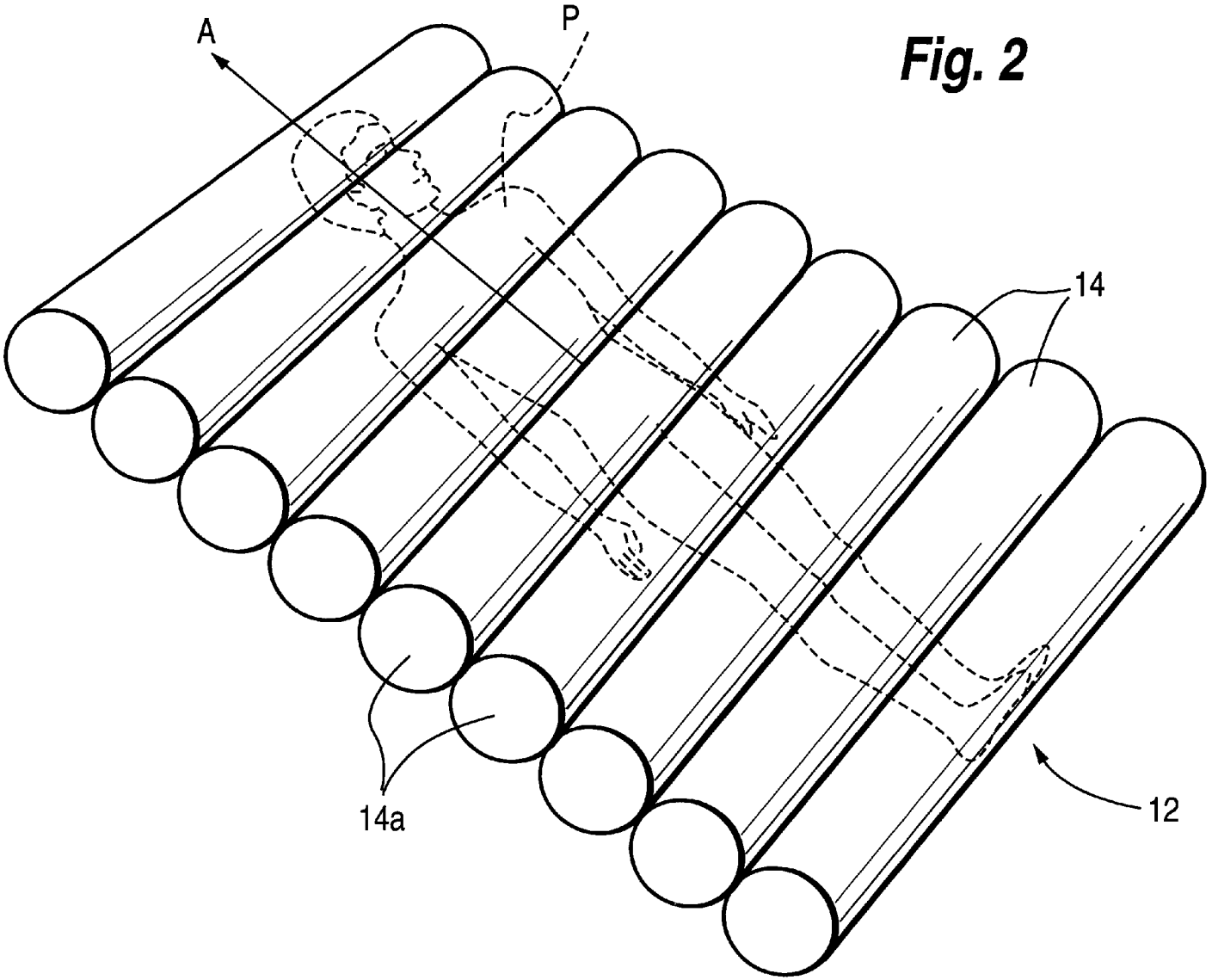
FIG. 2 is a perspective view of a preferred mattress according to the invention.

The support assembly 10 includes an inflatable mattress 12 preferably formed of vinyl or like material such as polyester film with or without vapor deposited aluminum including a plurality of individually inflatable chambers 14. In one arrangement, there are at least three individual chambers 14, including a head support chamber, a back support chamber, and a main body chamber. Each chamber includes a conventional valve 16 for inflating and deflating the chamber. In a preferred arrangement as shown in FIG. 2, the inflatable mattress 12 is provided with a plurality of horizontally disposed chambers 14A relative to a longitudinal axis of the mattress as defined by a head to toe position of a person P laying on the mattress 12. That is, the plurality of chambers 14A extend in a direction substantially perpendicular to the longitudinal axis A of the mattress 12. These chambers 14A may be individually inflatable or may be connected by appropriate air tubes to facilitate inflation.

The assembly also includes a cover 18 formed of cotton or other soft material that is shaped to encase the mattress 12. The cover 18 may be provided with fastening means (not shown) to secure the cover over the mattress 12. Alternatively, the cover 18 may be open ended enabling the cover to easily slip on and off of the mattress 12. Two pockets 20 are provided on a bottom surface of the cover 18 either by sewing or other suitable attaching methods. The pockets 20 each receive a rigid support member 22 formed of a plurality of curved or semi-tubular sections aligned adjacent one another. The pockets 20 may be provided with elastic inserts (not shown) that serve to close the pockets 20 and prevent the support members 22 from falling out. In order to provide adequate support for the user, the pockets 20 receiving the support members 22 are positioned adjacent a head/neck area and a back area, respectively, relative to the mattress 12.

Figure 3:
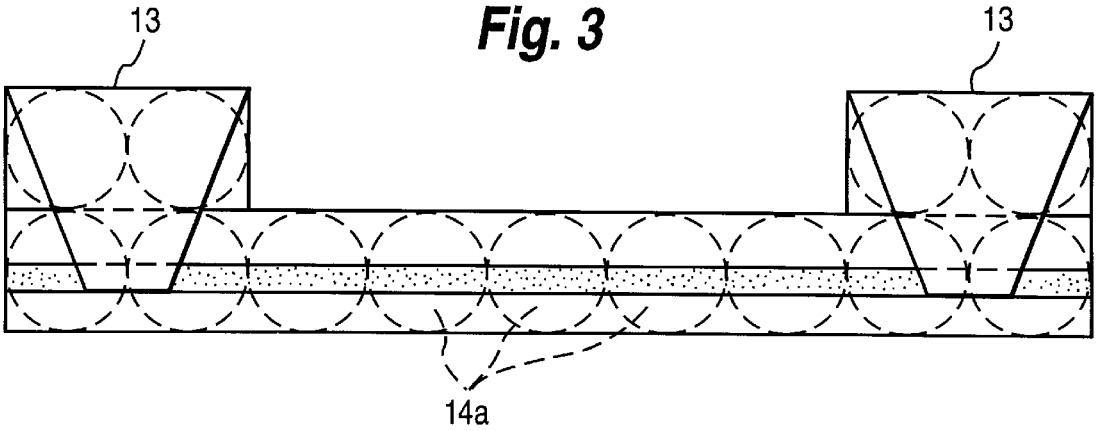
FIG. 3 is a side view of the mattress shown in FIG. 2.

In the arrangement of FIG. 2, as shown in FIG. 3, separately inflatable and attachable pillow attachments 13 including similar inflatable chambers 14A are attachable via a hook and loop fastener or the like anywhere along an attachment strip 19 secured to the cover 18. With this structure, the user can attach one or more pillows at desired locations.

The material from which the support members 22 are constructed is not critical, it being understood that the support members must be rigid in order to function in their intended manner as described. Preferably, however, the support members 22 are formed from a plastics material, for example, polyvinyl chloride (PVC) which is inherently rigid at room temperature (21 degrees C.). The plastics material may be compounded with any additive, including other plastics material, in order to "engineer" desired processing and/or end-use properties, for example, impact resistance, UV light resistance, coloration, and the like. The curved or semi-tubular sections serve to provide increased rigidity to the support members 22 with a lesser amount of material, thereby minimizing the weight and cost of the assembly.

Figure 4:
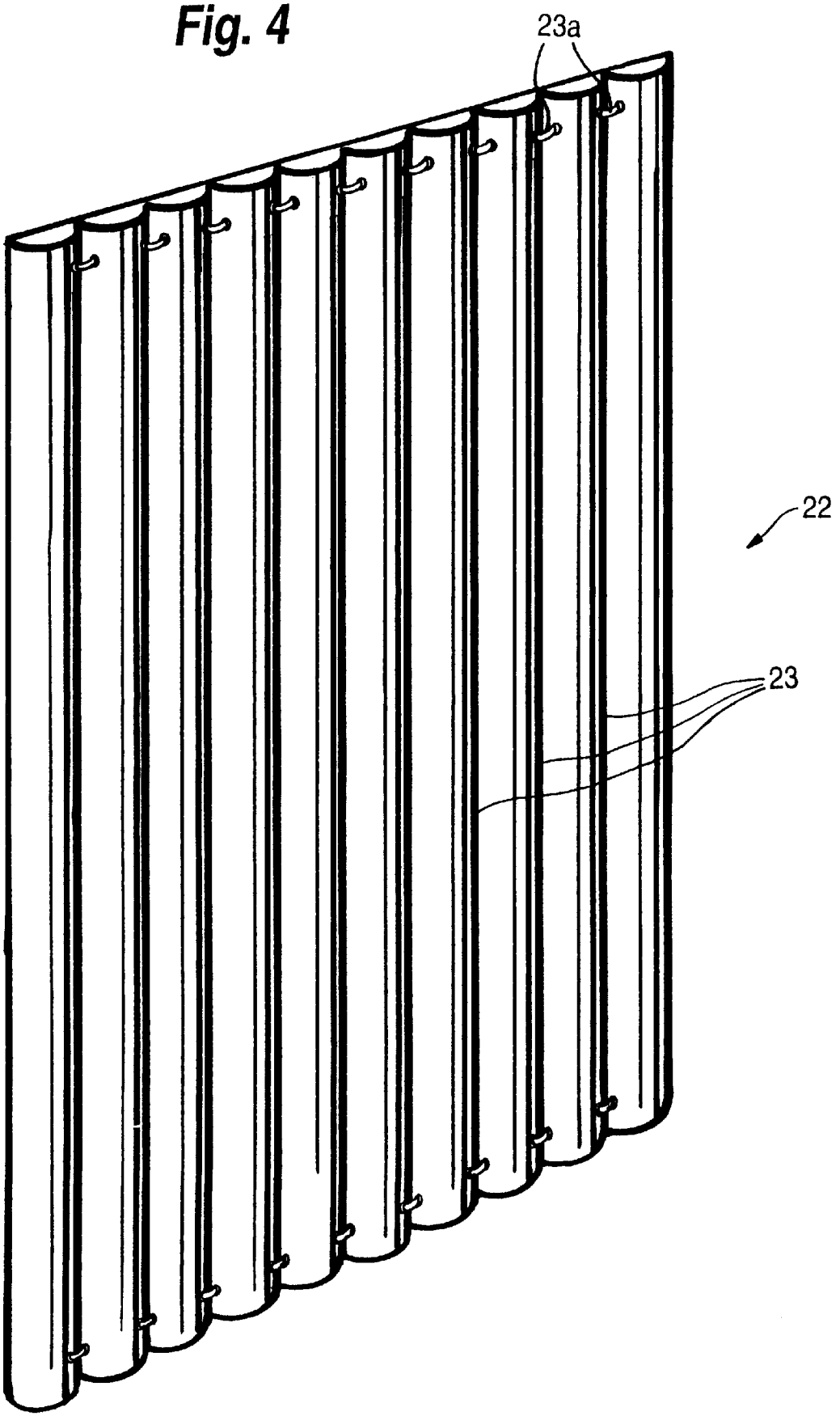
FIG. 4 is a perspective view of a support member.

As shown in FIG. 4, the plurality of curved or semi-tubular sections are aligned adjacent one another along longitudinal abutment axes 23 and are loosely secured to one another so as to be spaced between 0.01–0.625" apart. The sections are preferably banded together by a suitable connector 23A such that the sections are freely pivotable relative to one another along the longitudinal axes 23, respectively. As such, by virtue of the rigidity of the tubular sections, the support member 22 is configured to permit bending along the longitudinal axes 23, while resisting bending in other directions.

This structure significantly enhances comfort by allowing the user's body to determine the exact position each section of the support members 12 should take. The connector 23 preferably consists of a nylon belt extending through connecting apertures in distal ends of the sections, although those of ordinary skill in the art will contemplate alternative configurations to effect the desired result, and the invention is not meant to be limited to the illustrated arrangement. Alternative materials for the connector include, for example, plastic ties or other plastic connectors, leather, rubber, rope, etc.

The assembly is also provided with a portable electric air pump 24 or the like that is operatively engageable via a conventional valve assembly 26 with the valves 16 for the mattress chambers 14. With the electric air pump 24, the user can rapidly inflate the chambers 14 to desired pressure levels. In this context, because each of the plurality of chambers is independently inflatable, the user can separately adjust the chambers for comfort.

Figure 6:
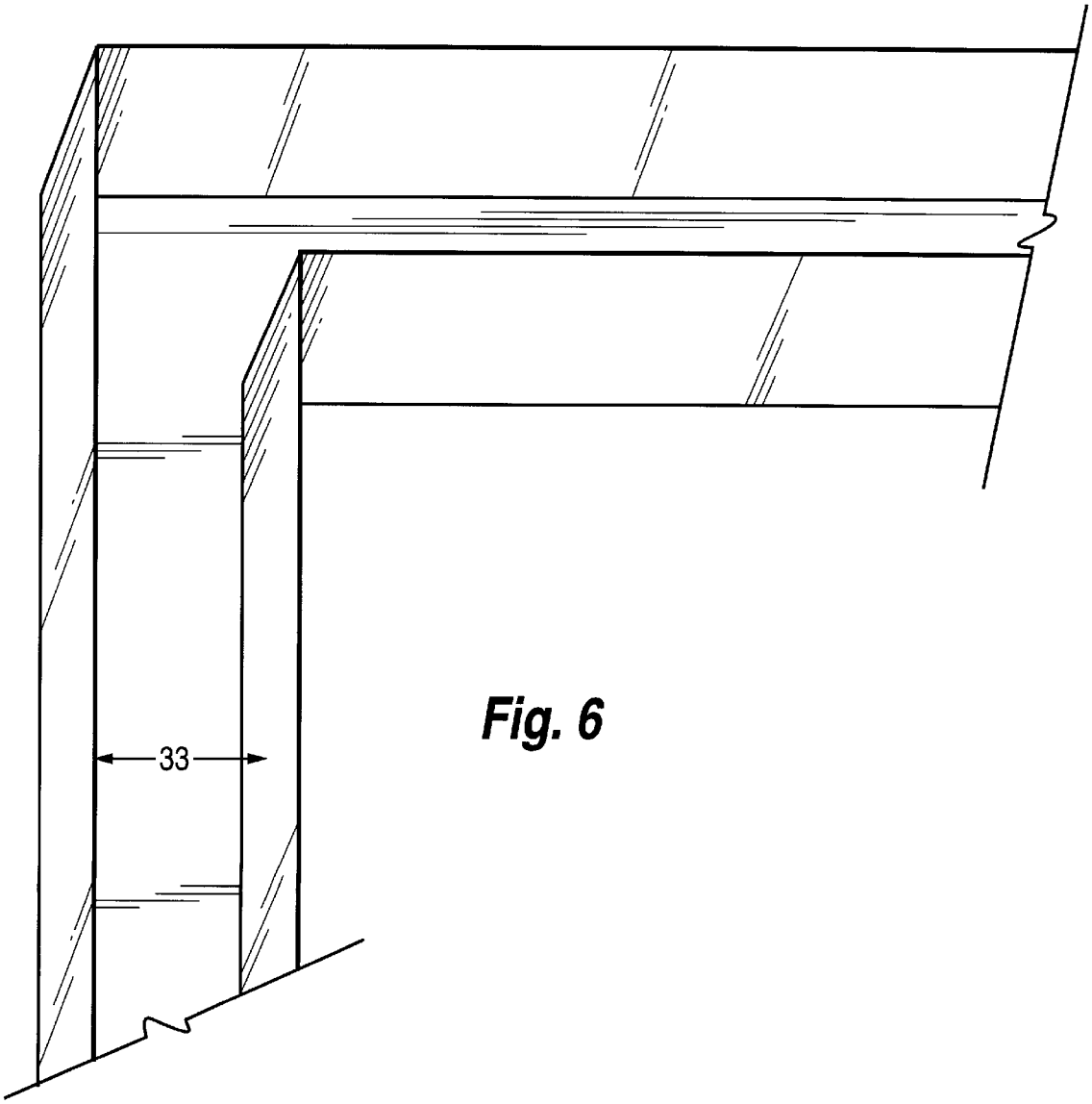
FIG. 6 illustrates an alternative feature of the carrying case according to the invention.
Figure 5:
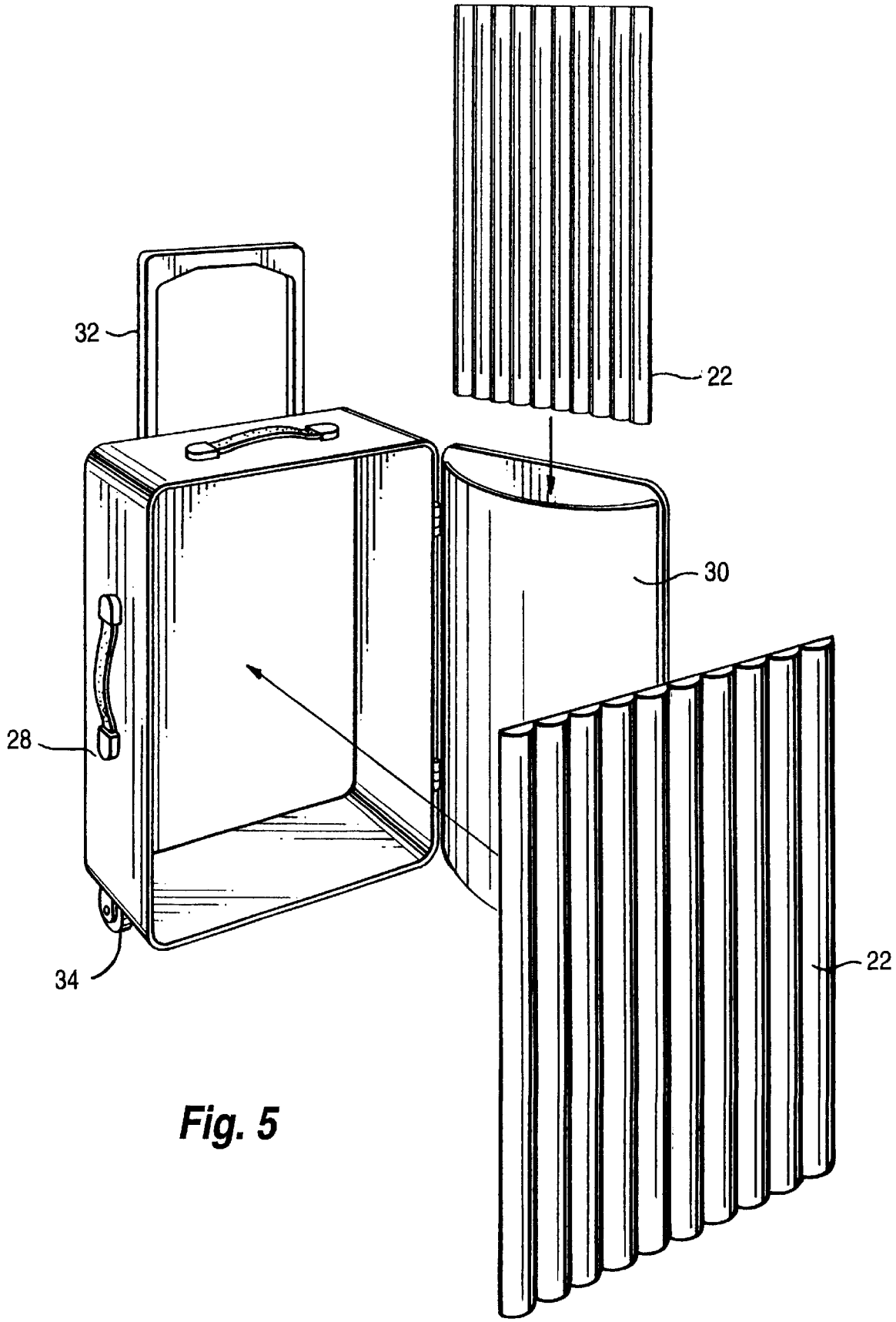
FIG. 5 is a perspective view of the carrying case illustrating the receiving locations for the support members.

Referring to FIG. 5, the assembly is also provided with a carrying case 28 that is sized to receive all of the assembly components. In particular, the carrying case 28 is sized substantially corresponding to the support members 22, such that the support members can be easily inserted and removed from the carrying case 28. The support members 22 may be secured in the carrying case with suitable elastic bands, a pocket 30, a zippered enclosure or the like as shown in FIG. 5. When deflated and folded, the inflatable mattress 12 can also be stowed in the carrying case 28 as well as the portable air pump 24. The carrying case 28 itself is formed of conventional structure such as one including a handle 32 and/or wheels 34. Because the support members 22 are flexible along the longitudinal axes as discussed above, the carrying case may be provided with tracks 31 as shown in FIG. 6 in upper and/or lower corners of the carrying case for receiving the support members 23.

By virtue of the structure according to the present invention, a traveler can be assured of adequate support and comfort regardless of the condition of the mattress on which the traveler is sleeping. Moreover, with the carrying case construction, the assembly is easy to travel with, and with the electric air pump, the assembly is easy to set up.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An inflatable support assembly comprising:

an inflatable mattress having at least one chamber;

a cover shaped to encase said mattress and having a support member receptacle; and at least one support member formed of a rigid material, said support member being configured to resist bending in a first direction while freely permitting bending in a second direction, wherein said support member is formed of a plurality of curved sections aligned adjacent one another along respective longitudinal abutment axes, and wherein each of said curved sections is pivotable relative to an adjacent one of said curved sections along respective ones of said longitudinal abutment axes.

2. An inflatable support assembly according to claim 1, wherein said cover comprises two support member receptacles, and wherein the assembly comprises two support members.

3. An inflatable support assembly according to claim 2, wherein said support member receptacles are positioned adjacent a head/neck and back area relative to said mattress.

4. An inflatable support assembly according to claim 2, wherein said support members are formed of a plurality of curved sections aligned adjacent one another.

5. An inflatable support assembly according to claim 2, further comprising a carrying case sized large enough to receive said mattress, said cover and said support members.

6. An inflatable support assembly according to claim 1, comprising at least three chambers.

7. An inflatable support assembly according to claim 6, wherein each of said chambers is individually inflatable.

8. An inflatable support assembly according to claim 7, further comprising a portable air pump operatively engageable with said chambers.

9. An inflatable support assembly according to claim 1, wherein said support member receptacle is positioned adjacent a back area relative to said inflatable mattress.

10. An inflatable support assembly according to claim 1, wherein said support member is formed of a plastics material.

11. An inflatable support assembly according to claim 1, further comprising a portable air pump operatively engageable with said plurality of chambers.

12. An inflatable support assembly according to claim 11, further comprising a carrying case sized large enough to receive said mattress, said cover, said support member and said air pump.

13. An inflatable support assembly according to claim 1, further comprising a carrying case sized large enough to receive said mattress, said cover and said support member.

14. An inflatable support assembly according to claim 13, wherein said carrying case comprises a pocket sized to receive said support member.

15. An inflatable support assembly according to claim 1, wherein each of said curved sections comprises a connecting aperture at distal ends thereof, said support member comprising at least one connector extending through the connecting apertures.

16. An inflatable support assembly according to claim 15, wherein said at least one connector comprises a nylon belt.

17. An inflatable support assembly according to claim 15, wherein said at least one connector comprises a plurality of plastic ties.

18. An inflatable support assembly according to claim 15, wherein said at least one connector is formed of one of leather, rubber or rope.

19. An inflatable support unit comprising:

an inflatable mattress having at least one chamber;

a cover disposed encasing said mattress and having a support member receptacle; and at least one support member formed of a rigid material, said support member being disposed in said support member receptacle and being configured to resist bending in a first direction while freely permitting bending in a second direction, wherein said support member is formed of a plurality of curved sections aligned adjacent one another along respective longitudinal abutment axes, and wherein each of said curved sections is pivotable relative to an adjacent one of said curved sections along respective ones of said longitudinal abutment axes.

20. An inflatable support unit according to claim 19, wherein said cover comprises two support member receptacles, and wherein the assembly comprises two support members disposed in said support member receptacles.

21. An inflatable support assembly according to claim 20, wherein said support member receptacles are positioned adjacent a head/neck and back area relative to said inflatable mattress.

22. An inflatable support assembly according to claim 19, wherein each of said curved sections comprises a connecting aperture at distal ends thereof, said support member comprising at least one connector extending through the connecting apertures.

23. An inflatable support mattress kit comprising:

an inflatable mattress having at least one chamber;

a cover shaped to encase said mattress and having two support member receptacles;

two support members formed of a rigid material, said support members being configured to resist bending in a first direction while freely permitting bending in a second direction, wherein said support members are formed of a plurality of curved sections aligned adjacent one another along respective longitudinal abutment axes, and wherein each of said curved sections is pivotable relative to an adjacent one of said curved sections along respective ones of said longitudinal abutment axes;

a portable air pump operatively engageable with said at least one chamber; and a carrying case sized large enough to receive said mattress, said cover, said support members and said air pump.

24. An inflatable support assembly comprising:

an inflatable mattress having at least one chamber;

a cover shaped to encase said mattress and having a support member receptacle; and at least one support member formed of a rigid material, said support member being configured to resist bending in a first direction while freely permitting bending in a second direction, wherein said support member is formed of a plurality of curved sections aligned adjacent one another along respective longitudinal abutment axes, and wherein each of said curved sections is loosely secured to an adjacent one of said curved sections such that each of said curved sections is pivotable relative to the adjacent one of said curved sections along respective ones of said longitudinal abutment axes.

* * * * *